US008662363B2

(12) United States Patent
Williams

(10) Patent No.: US 8,662,363 B2
(45) Date of Patent: Mar. 4, 2014

(54) GOLF CAR ACCESSORY

(76) Inventor: Dennis Williams, Humboldt, IA (US)

( * ) Notice: Subject to any disclaimer, the term of this patent is extended or adjusted under 35 U.S.C. 154(b) by 1774 days.

(21) Appl. No.: 11/380,033

(22) Filed: Apr. 25, 2006

(65) Prior Publication Data

US 2007/0068983 A1 Mar. 29, 2007

Related U.S. Application Data

(60) Provisional application No. 60/720,731, filed on Sep. 27, 2005.

(51) Int. Cl.
*B60R 9/00* (2006.01)

(52) U.S. Cl.
USPC ..... 224/274; 14/21

(58) Field of Classification Search
USPC ..... 224/274
See application file for complete search history.

(56) References Cited

U.S. PATENT DOCUMENTS

| | | | | |
|---|---|---|---|---|
| 3,380,095 | A | 4/1968 | Piper, Jr. | |
| 4,533,013 | A * | 8/1985 | Hightower | 180/210 |
| 4,722,103 | A * | 2/1988 | Kliebert | 4/658 |
| 5,052,604 | A * | 10/1991 | Tourangeau | 224/274 |
| 5,556,064 | A * | 9/1996 | Cowe | 248/172 |
| 5,620,125 | A * | 4/1997 | Duncan et al. | 224/515 |
| 5,806,738 | A * | 9/1998 | D'Angelo | 224/521 |
| 6,039,227 | A * | 3/2000 | Stark | 224/521 |
| 6,070,926 | A * | 6/2000 | Hardin | 296/26.08 |
| D437,578 | S * | 2/2001 | Stannard-Warne | D12/406 |
| 6,253,395 | B1 * | 7/2001 | Quam | 4/658 |
| 6,269,578 | B1 * | 8/2001 | Callegari | 42/94 |
| 6,422,641 | B1 * | 7/2002 | Coryell | 296/182.1 |
| 6,425,562 | B1 | 7/2002 | Knudson | |
| 6,427,854 | B1 * | 8/2002 | Grossi et al. | 211/85.7 |
| 6,494,352 | B1 * | 12/2002 | Mullen | 224/524 |
| 6,745,424 | B1 * | 6/2004 | Pimentel et al. | 15/21.2 |
| 2003/0168487 | A1 * | 9/2003 | Lane et al. | 224/499 |
| 2005/0005384 | A1 | 1/2005 | Finley | |

OTHER PUBLICATIONS

"Deluxe Ball Washer Stand", www.cartbarn.com/product_info.php?cPath=79&products_id=275, Oct. 10, 2005, 1 page.

* cited by examiner

*Primary Examiner* — Justin Larson
*Assistant Examiner* — Peter Helvey
(74) *Attorney, Agent, or Firm* — McKee, Voorhees & Sease, P.L.C.

(57) ABSTRACT

The golf car accessory includes a bag divider adapted for attachment to a golf car to separate bags placed in the golf car. A first arm extends upwardly from the bag divider and a second arm operatively connected to the first arm and extending outwardly to support a ball washer. Preferably the first arm is a telescoping arm so that the height of the ball washer is adjustable. Preferably the second arm is also a telescoping arm so that the horizontal position of the ball washer can be adjusted.

11 Claims, 6 Drawing Sheets

GOLF CAR ACCESSORY

CROSS-REFERENCE TO RELATED APPLICATIONS

This application claims priority under 35 U.S.C. §119 of a provisional application Ser. No. 60/720,731 filed Sep. 27, 2005, which application is hereby incorporated by reference in its entirety.

BACKGROUND OF THE INVENTION

The present invention relates to a golf car accessory. The term "golf car" as used herein, generally refers to a motorized golf carts as is well known in the art. More particularly, the present invention relates to a golf car accessory that may be used with a golf club washer and/or golf ball washer.

The prior art discloses various instances where a golf ball washer is attached to either a golf cart of a golf car. For example, U.S. Pat. No. 3,380,095 to Piper, Jr. discloses a portable golf ball washer which may be attached to a hand cart. U.S. Pat. No. 6,425,562 to Knudson discloses a bracket for suspending a washing basin from a cart. U.S. Patent Publication No. 2005/0005384 to Finley discloses attaching a ball washer device to the bumper of a golf cart. Despite these various advancements in the art, problems remain.

One of the problems with golf ball or club washers and attaching them to a golf car is that in operation, liquid used for washing may spill onto the golf car, golf bags, clubs, or people in close proximity. This highly undesirably and inconvenient. What is needed is a means to support a golf ball washer from a golf car that prevents or avoids this problem, yet is still convenient and easy to use.

BRIEF SUMMARY OF THE INVENTION

Therefore it is a primary object, feature, or advantage of the present invention to provide a golf car accessory that improves over the state of the art.

It is a further object, feature, or advantage of the present invention to provide a golf ball and club washer mount for a golf car.

It is another object, feature, or advantage of the present invention to provide a golf ball and club washer mount that telescopes out and over the rear of a golf car.

Yet another object, feature, or advantage of the present invention is to provide a golf ball and club washer mount that can adjust the position of the washer up and down.

A further object, feature, or advantage of the present invention is to provide a golf ball and club washer mount that allows one to adjust the position of the washer inwardly and outwardly.

A still further object, feature, or advantage of the present invention is to provide a golf car accessory that includes a golf bag separator.

Yet another object, feature, or advantage of the present invention is to provide a golf ball and club washer mount that allows the washer to be easily and conveniently removed for washing.

A still further object, feature, or advantage of the present invention is to provide a golf ball and club washer mount that easily mounts to a variety of different golf cars.

Another object, feature, or advantage of the present invention is to provide a mount for a golf ball washer that protects against splashing.

One or more of these and/or other objects, features, or advantages of the present invention will become apparent from the specification and claims that follow.

According to one embodiment of the present invention, a golf car accessory is provided. The golf car accessory includes a bag divider adapted for attachment to a golf car to separate bags placed in the golf car. A first arm extends upwardly from the bag divider and a second arm operatively connected to the first arm and extending outwardly to support a ball washer. Preferably the first arm is a telescoping arm so that the height of the ball washer is adjustable. Preferably the second arm is also a telescoping arm so that the horizontal position of the ball washer can be adjusted.

According to another embodiment of the present invention, a golf car is provided. The golf car includes a golf car body having a front and a rear. There is a rear bumper operatively connected to the golf car body at the rear of the golf car body. A bag divider is attached proximate the rear bumper to separate bags placed in the golf car. A first arm extends upwardly from the bag divider. A second arm is operatively connected to the first arm and extends outwardly from the first arm. A ball washer is operatively connected to the second arm.

According to another aspect of the present invention a golf car accessory is provided. The golf car accessory includes a bag divider for attachment to a golf car proximate a rear bumper of the golf car. The bag divider provides for separating bags placed in the golf car. A first arm extends upwardly from the bag divider. A second arm is operatively connected to the first arm and extends outwardly from the rear bumper of the golf car to support a golf ball washer. The second arm is adjustable to alter distance of the golf ball washer from the golf car. A splash guard is operatively connected to the second arm to protect the golf car from splashing associated with use of the golf ball washer.

DETAILED DESCRIPTION OF THE PREFERRED EMBODIMENT

The present invention provides for mounting a ball washer to a golf car. Although the term "ball washer" is used throughout this disclosure, it is to be understood that the term may include a club head washer as well.

Figure 1:
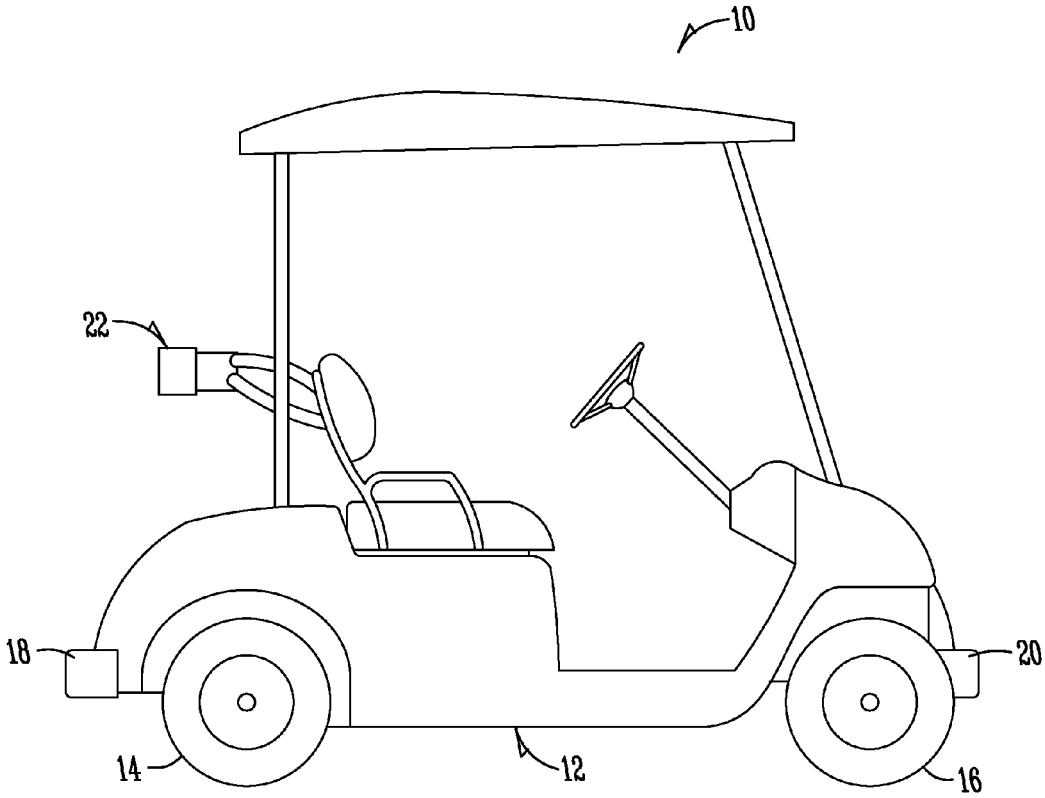
Fig. 1 (PRIOR ART)
FIG. 1 is a side view showing a prior art golf car.

FIG. 1 provides a side view of one embodiment of a prior art golf car. The golf car 10 includes a golf car body 12. Tires 14 and 16 are shown on opposite ends of the golf car body 12. The golf car 10 has a rear bumper 18 and a front bumper 20. A golf bag holder 22 is shown at the rear of the golf car 10.

Figure 2:
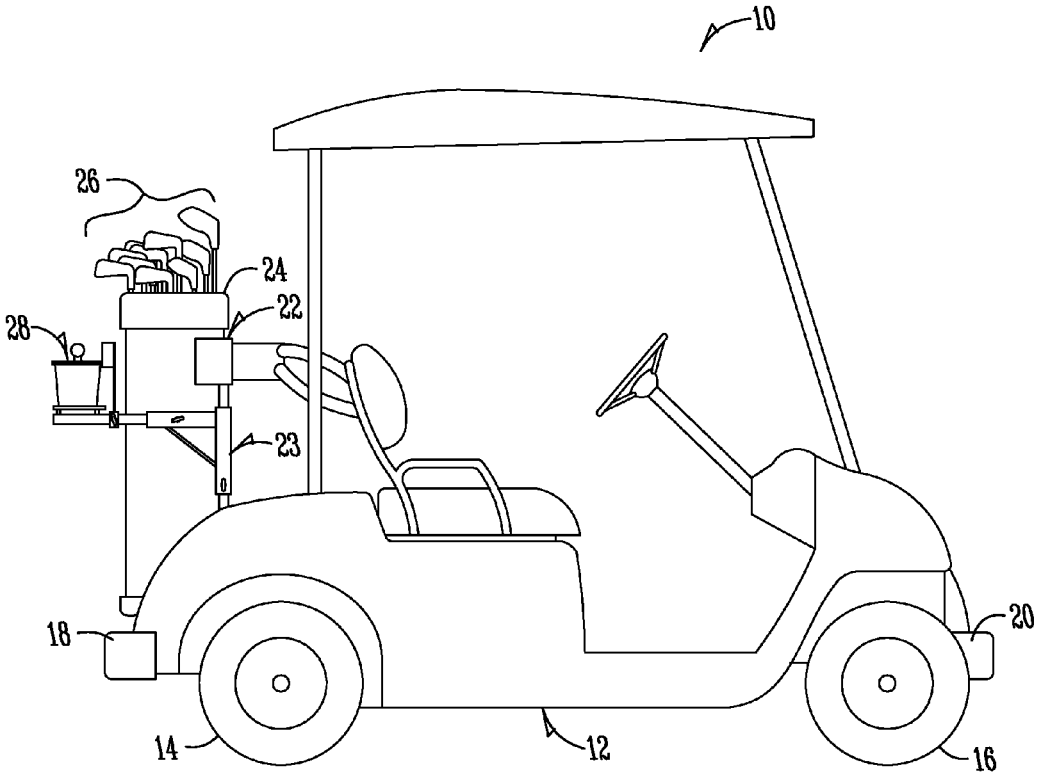
FIG. 2 is a side view illustrating a golf car with the golf cart accessory of the present invention, with a golf ball washer and a golf bag.

In FIG. 2, a golf car 10 is shown with one embodiment of the golf car accessory 23 of the present invention installed in the golf car 10. The golf car 10 has a golf car accessory 23 installed. The golf car accessory 23 accommodates golf bags such as golf bag 24 containing golf clubs 26, providing a divider or separator between two or more bags of clubs. The golf car accessory 23 also provides for mounting a golf ball washer 28.

Figure 3:
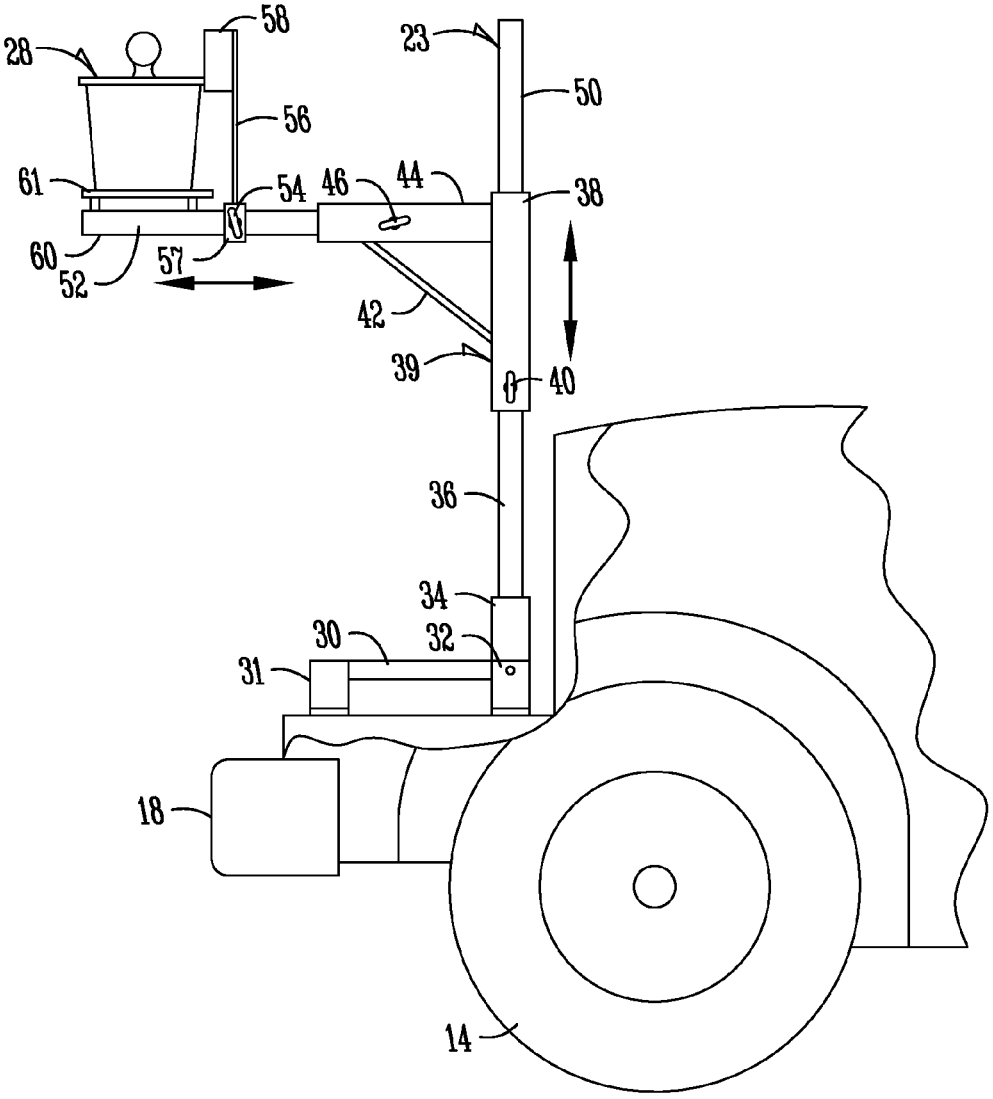
FIG. 3 is a sectional view of a golf car with one embodiment of a golf car accessory of the present invention mounted to the golf car and with a ball washer in place.
Figure 4:
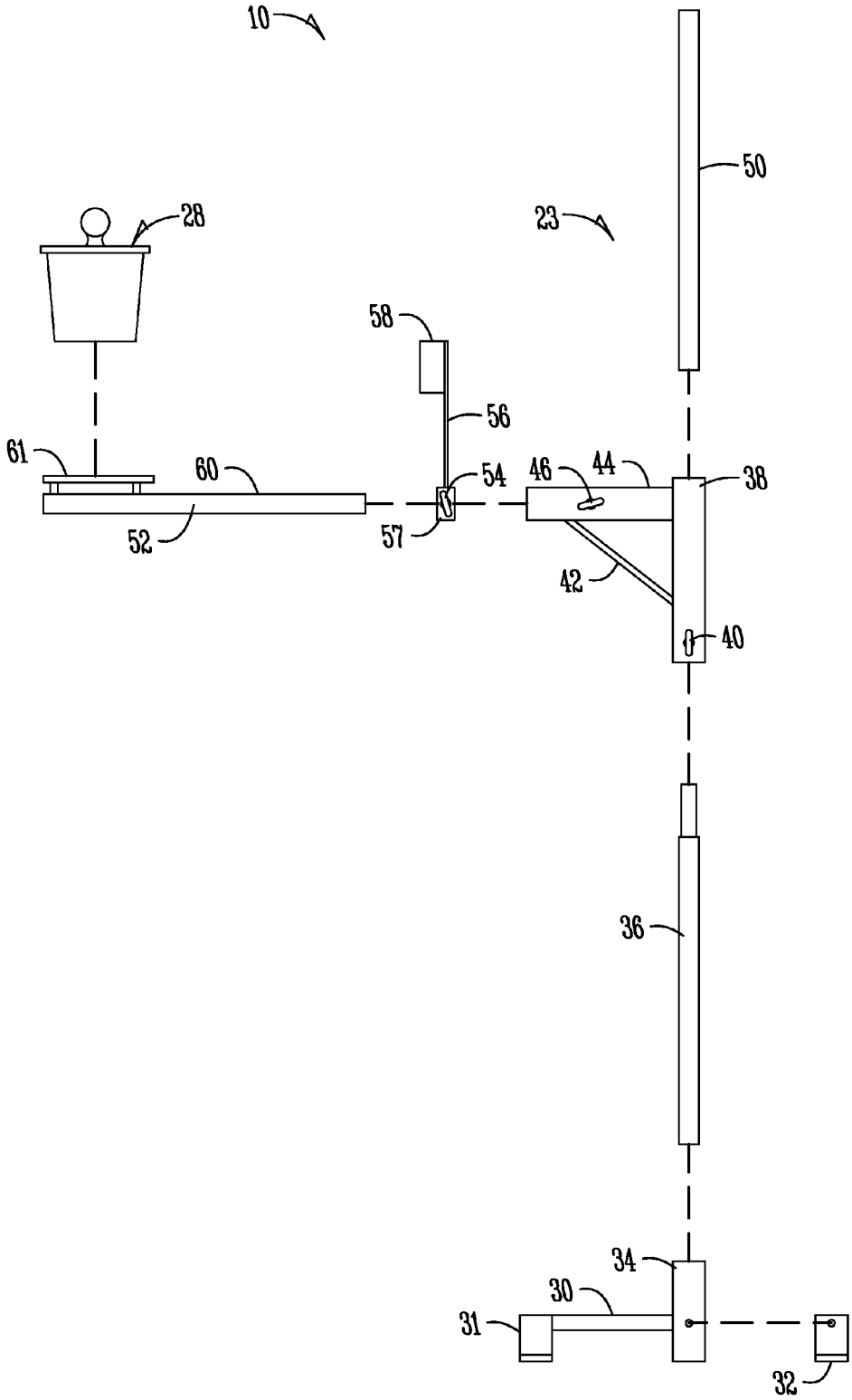
FIG. 4 is an exploded view of one embodiment of the golf car accessory of the present invention.
Figure 5:
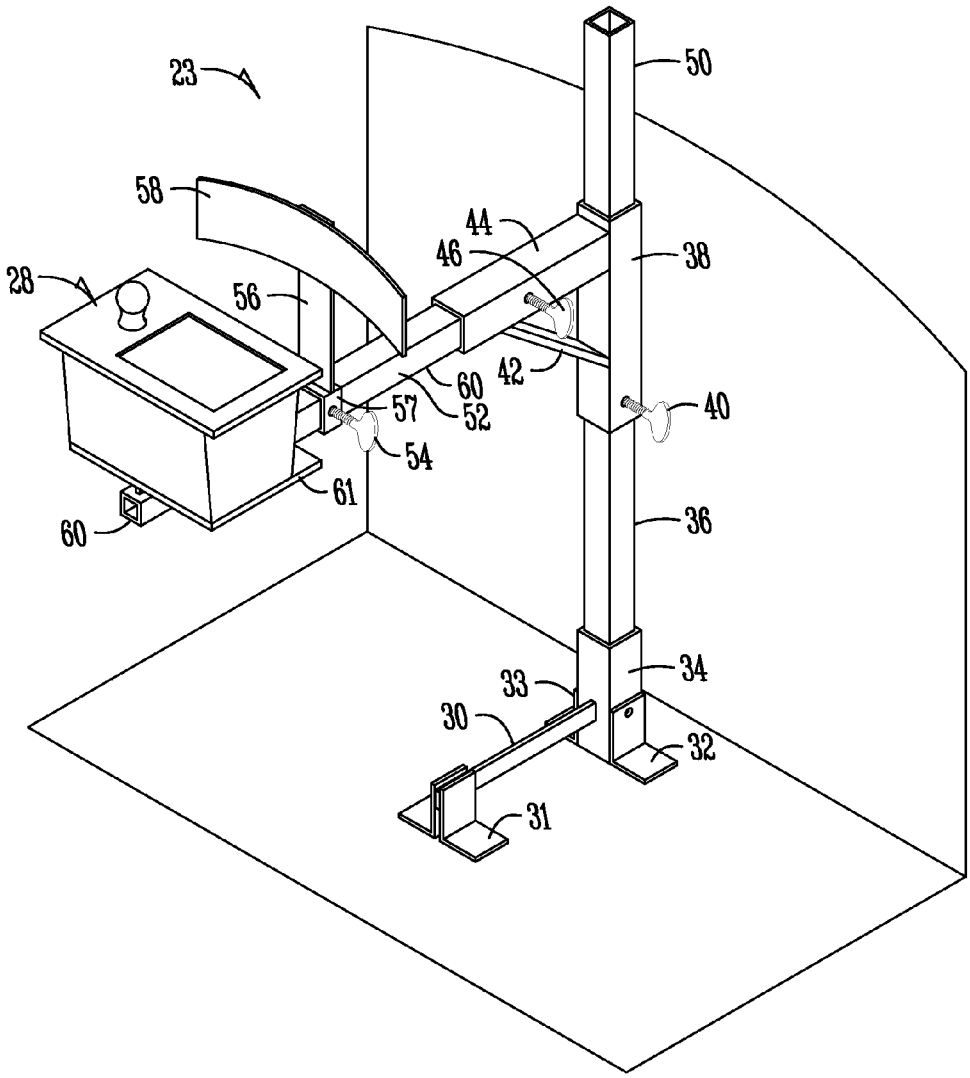
FIG. 5 is a perspective view of one embodiment of the golf car accessory.
Figure 6:
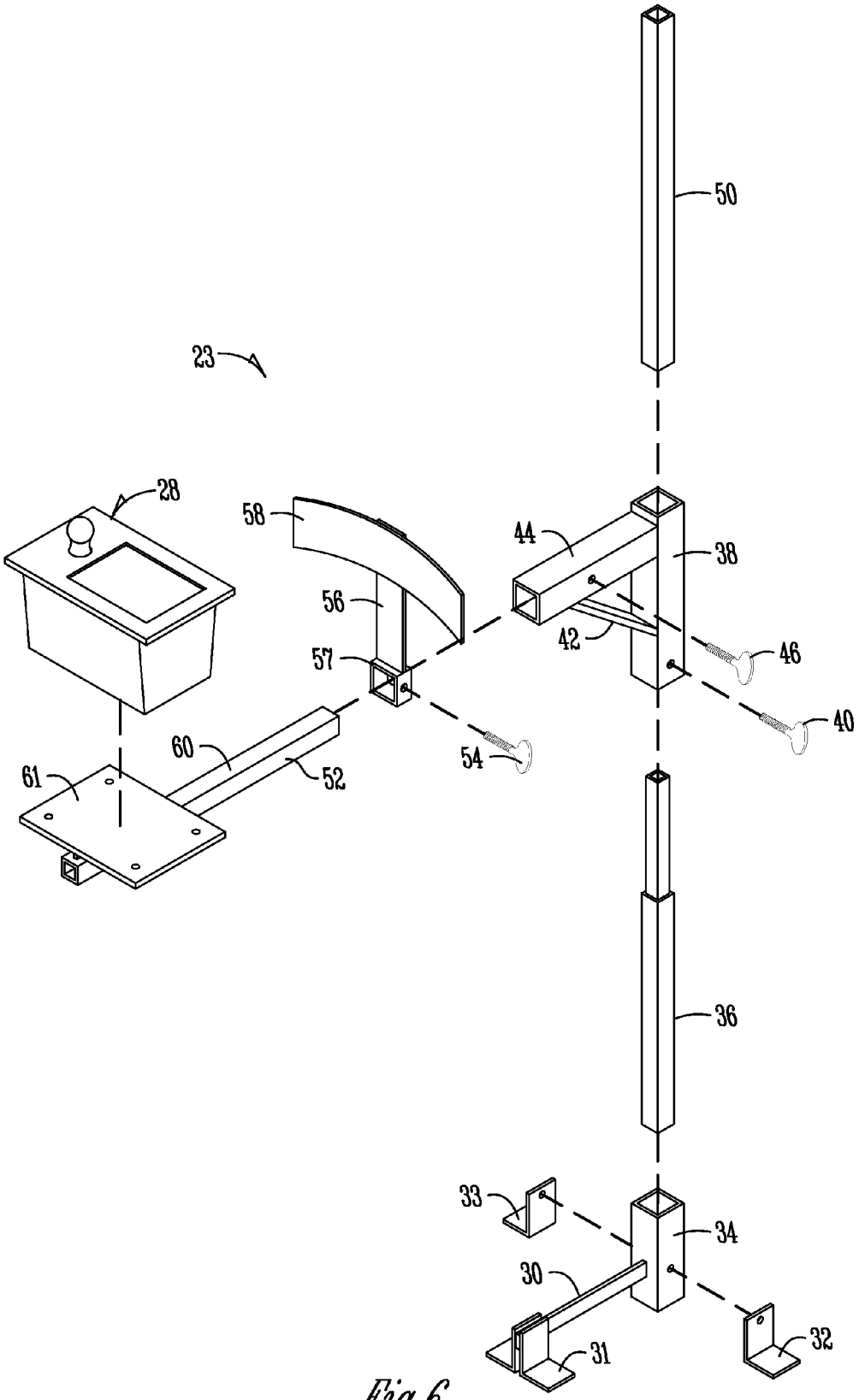
FIG. 6 is an exploded perspective view of one embodiment of the golf car accessory.

FIG. 3 provides a side view of the device 23 mounted to a golf car. As shown in FIG. 3, a rear divider support bracket 31 and a front divider support bracket 32 are shown with a divider 30 between the rear driver support bracket 31 and the front divider support bracket 32. An arm support 34 is also operatively connected to the front divider support bracket 32. The arm support 34 provides for supporting an arm 36. The arm 36 extends upwardly. It is to be understood that the arm 36 need not extend directly upwardly but may extend diagonally upwardly as may be appropriate in a particular installation. Preferably, the arm 36 connects with a telescoping arm portion 50 to thereby allow convenient height adjustment. A first bracket member 38 and a second bracket member 44 are shown with a cross member 42 operatively connected between the first bracket member 38 and the second bracket member 44 in order to provide additional support. The first bracket member 38 can be positioned along the length of the first arm 50 in a telescoping manner to position or reposition the device 23 in a manner appropriate for a particular installation. A thumb screw 40 is shown for retaining the first bracket member's 38 position along the first arm 50. A second arm 52 is shown which extends generally outwardly from the first arm 50 and is telescoping and adjustable relative to the second bracket member 44. A thumb screw 46 is used for retaining the position of the second arm. Thus, the bracket 39 can be adjusted upwardly and downwardly along the first arm and the second arm 52 can be adjusted inwardly and outwardly in a telescoping manner from the second arm 44.

A ball washer mounting plate 60 is operatively connected to the second arm 52. A ball washer stand 61 is placed on the ball washer mounting plate 60. The ball washer is then mounted to the ball washer stand 61 and the ball washer mounting plate 60. Preferably, a splash guard support 56 is operatively connected to the ball washer mounting plate 60 and/or the second arm 52. A splash guard 58 is operatively connected to the splash guard support 56.

The bag divider 30 serves as a wall to separate or divide the space provided for storing golf bags in the back of a golf car. The presence of the bag divider 30 separates the golf bags to reduce or eliminate the problems of storing golf bags side-by-side, including having clubs from one golf bag coming in contact with and potentially scratching or marring clubs from the other golf bag. Of course, the bag divider 30 in addition to serving as a divider, serves as a support structure for the first arm 36. The first arm 36 further provides for separating golf bags stowed in the golf cart.

The first arm 36 extends upwardly preferably at a diagonal relative to the rear bumper 18 of the golf car 10. Preferably, the first arm 36 includes a telescoping extension 50 so that it can be extended and retracted to different heights as may be needed in different installations or as may be desired by the user. The second arm 60 extends outwardly to different distances. Preferably, the second arm 60 extends to or beyond the end of the golf car so that when the ball washer 28 is used, there is no dripping or spillage onto the golf car or the golf bags stowed in the golf car.

The ball washer 28 is preferably removeably attached or connected so that the ball washer 28 can be removed for washing. In addition, the golf car accessory 23 is preferably universal so that it can be easily mounted on any golf car, and with various types of golf ball washers.

Support members may also be attached to and extend outwardly from the first arm 36 to further support golf bags. Preferably, in operation, the second arm 60 is extending outwardly well beyond the golf bags. The various components can be attached to one another or a golf car body in various ways, including the rivets, brackets or other types of fasteners or attachment structures. The golf car accessory can be made of any number of materials or combinations of materials, including metals and plastics. The present invention is not to be limited to a particular manner in which the components are attached to one another, their composition or the manner in which the components are attached to the golf car.

Thus, that which is shown is merely an exemplary embodiment. The present invention contemplates numerous variations including variations in the structures, shapes, and sizes of various structural elements including the bag divider, the first arm, the second arm, and the ball washer; variations in the manner in which the parts are attached to one another, varieties in composition, and other variations. These and other variations are all within the broad spirit and scope of the invention.

What is claimed is:

1. A golf car accessory, comprising:

a front divider support bracket adapted to attach to a golf bag support surface of a golf car;

a rear divider support bracket adapted to attach to the golf bag support surface of the golf car;

a bag divider attached between and extending horizontally between the front divider support bracket and the rear divider support bracket to thereby separate a first golf bag and a second golf bag placed side-by-side in the golf car and on the golf bag support surface of the golf car;

an arm support attached to the bag divider and the front divider support bracket;

a first arm extending upwardly from the arm support between the first golf bag and the second golf bag;

a second arm operatively connected to the first arm and extending outwardly between and beyond the first golf bag and the second golf bag to support a ball washer; and wherein the bag divider extends outwardly from the first arm and provides support for the first arm.

2. The golf car accessory of claim 1 wherein the first arm is a telescoping arm.

3. The golf car accessory of claim 1 wherein the second arm is a telescoping arm.

4. The golf car accessory of claim 3 wherein the second arm extends rearwardly beyond a bumper of the golf car.

5. The golf car accessory of claim 1 wherein the first arm extends upwardly at a diagonal relative to the bag divider.

6. The golf car accessory of claim 1 further comprising the ball washer, the ball washer operatively connected to the second arm.

7. The golf car accessory of claim 6 further comprising a splash guard operatively connected to the second arm and positioned proximate the ball washer to protect against splashing.

8. A golf car accessory, comprising:

a front divider support bracket adapted to attach to a golf bag support surface of a golf car;

a bag divider attached to the front divider support bracket and extending horizontally in a rearward direction therefrom to thereby extend towards the rear bumper of the golf car and to separate golf bags placed on the golf bag support surface of the golf car;

an arm support attached to the bag divider and the front divider support bracket;

a first arm extending upwardly from the arm support;

a second arm operatively connected to the first arm and adapted for extending outwardly from the rear bumper of the golf car between the bags placed in the golf car and beyond the bags to support a golf ball washer;

wherein the second arm being adjustable to alter distance of the golf ball washer from the golf car;

a splash guard operatively connected to the second arm at a position between the golf ball washer and the golf car to protect the golf car from splashing associated with the use of the golf ball washer.

9. The golf car accessory of claim 8 further comprising a bracket having a first bracket member positioned over the first arm and a second bracket member attached to the second arm to thereby provide for adjusting position of the second arm relative to the first arm.

10. The golf car accessory of claim 9 further comprising a golf ball washer mounting plate for operative connection between the golf ball washer and the second arm to assist in supporting the golf ball washer.

11. A golf car accessory comprising:

a front divider support bracket adapted to attach to a golf bag support surface of a golf car;

a rear divider support bracket adapted to attach to the golf bag support surface of the golf car;

a bag divider attached between and extending horizontally between the front divider support bracket and the rear divider support bracket to thereby separate a first golf bag and a second golf bag placed side-by-side in the golf car on the golf bag support surface;

a first arm extending upwardly from the bag divider and the front divider support bracket and between the first golf bag and the second golf bag;

a ball washer;

a second arm operatively connected to the first arm and extending outwardly between and beyond the first golf bag and the second golf bag to support the ball washer;

wherein the bag divider extends outwardly from the first arm and provides support for the first arm;

wherein the second arm being adjustable to alter distance of the golf ball washer from the golf car;

a splash guard operatively connected to the second arm at a position between the golf ball washer and the golf car to protect the golf car from splashing associated with the use of the golf ball washer.

* * * * *